US005701879A

United States Patent [19]

Johnson et al.

[11] Patent Number: 5,701,879

[45] Date of Patent: *Dec. 30, 1997

[54] COMPRESSED AIR GUN WITH SINGLE ACTION PUMP

[75] Inventors: Lonnie G. Johnson, Smyrna; John Applewhite, Atlanta, both of Ga.

[73] Assignee: Johnson Research & Development Company, Inc., Smyrna, Ga.

[ * ] Notice: The term of this patent shall not extend beyond the expiration date of Pat. No. 5,553,598.

[21] Appl. No.: 451,480

[22] Filed: May 26, 1995

Related U.S. Application Data

[63] Continuation-in-part of Ser. No. 223,559, Apr. 6, 1994, Pat. No. 5,553,598.

[51] Int. Cl.[6] ..... F41B 11/00

[52] U.S. Cl. ..... 124/69; 124/63; 124/75

[58] Field of Search ..... 124/56, 63, 64, 124/65, 69, 71, 73, 75

[56] References Cited

U.S. PATENT DOCUMENTS

| | | | |
|---|---|---|---|
| 2,725,868 | 12/1955 | Foster | 124/64 X |
| 2,733,699 | 2/1956 | Krinsky | 124/69 |
| 2,762,356 | 9/1956 | Foster | 124/65 |
| 2,927,398 | 3/1960 | Kaye et al. | 446/212 |
| 3,025,633 | 3/1962 | Kaye et al. | 446/212 |
| 3,121,292 | 2/1964 | Butler et al. | 446/212 |
| 3,962,818 | 6/1976 | Pippin, Jr. | 446/212 |
| 4,159,705 | 7/1979 | Jacoby | 124/63 |
| 4,223,472 | 9/1980 | Fekete et al. | 446/192 |
| 4,411,249 | 10/1983 | Fogarty et al. | 124/64 |
| 4,897,065 | 1/1990 | Fertig et al. | 446/63 |
| 5,188,557 | 2/1993 | Brown | 446/212 |
| 5,553,598 | 9/1996 | Johnson et al. | 124/63 |

FOREIGN PATENT DOCUMENTS 2587911 4/1987 France .

*Primary Examiner*—John A. Ricci
*Attorney, Agent, or Firm*—Kennedy, Davis & Kennedy

[57] ABSTRACT

An air compressed gun (10) is provided having a stock (11), a barrel (12), a pressure chamber (16), a pressure actuatable release valve (18) and a manual air pump (14). The pump has an elongated cylinder (25) having a port (38) in fluid communication with the release valve, and a plunger (26) telescopically mounted for reciprocal movement within the cylinder. The plunger has an O-ring type seal (31). The forward movement of the plunger seal towards the port pressurizes air within the cylinder which is transferred to the release valve and pressure chamber. The continued movement of the plunger seal past the port causes a portion of the pressurized air to be released so as to actuate the pressure actuatable release valve to release the pressurized air within the pressure chamber into the barrel.

16 Claims, 1 Drawing Sheet

COMPRESSED AIR GUN WITH SINGLE ACTION PUMP

REFERENCE TO RELATED APPLICATION

This application is a continuation in part of application Ser. No. 08/223,559, filed Apr. 6, 1994 now U.S. Pat. No. 5,553,598.

TECHNICAL FIELD

This invention relates to compressed air guns, and specifically to compressed air guns having pumps which pressurize air and trigger the release of the pressurized air.

BACKGROUND OF THE INVENTION

Guns which shoot or launch projectiles have been very popular for many years. These guns have been designed to launch projectiles in a number of ways. A common method of launching has been by the compression of a spring which propels the projectile upon its decompression or release, as, for example, with BB guns and dart guns. These guns however usually do not generate enough force to launch projectiles with great velocity.

Toy guns have also been designed which use compressed air to launch projectiles such as foam darts. These types of guns use a reciprocating air pump to pressurize air within a pressure tank. In use, the pump is typically reciprocated several times to pressurize air which is later released through actuation of a trigger. Therefore, children must actuate two components in order to fire a projectile. Additionally, this dual actuation may be undesired when time is of the essence and a rapid pressurization and firing of the gun is desired.

Accordingly, it is seen that a need remains for an air gun which may be rapidly pressurized and fired. It is to the provision of such therefore that the present invention is primarily directed.

SUMMARY OF THE INVENTION

In a preferred form of the invention a compressed air gun comprises a projectile launch tube, a pressure chamber in fluid communication with the launch tube, a pressure actuatable release valve means for triggering the release of pressurized air from the pressure chamber into the launch tube, and a manual air pump. The manual air pump has a vented air cylinder with an open end, a closed end and a port spaced from the closed end, and a plunger that extends into the cylinder through the cylinder open end. The plunger has a seal mounted in sliding, sealing engagement with the cylinder. With this construction, an inward stroke of the plunger seal toward the cylinder port pumps air into the pressure chamber through the release valve means and passage of the plunger seal past the port actuates the release valve means which triggers the release of pressurized air from the pressure chamber into the launch tube.

DETAILED DESCRIPTION

Figure 1:
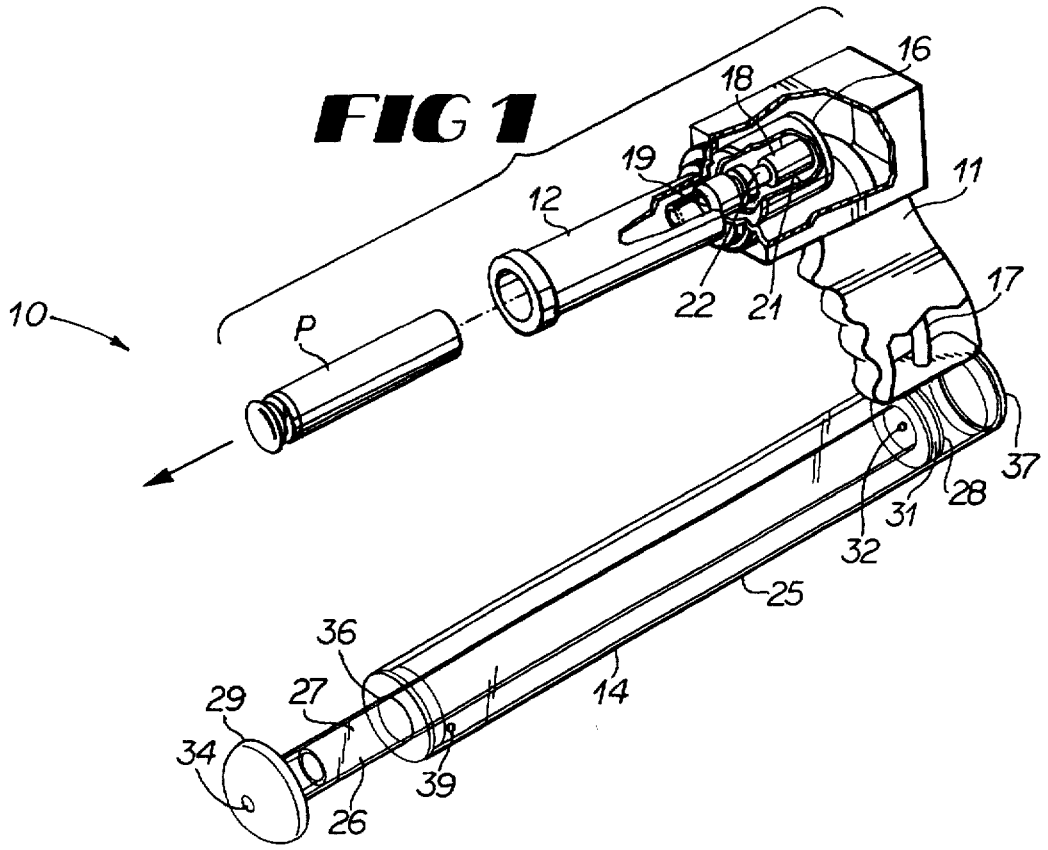
FIG. 1 is a perspective view of a compressed air gun embodying principles of the present invention in a preferred form with portions of the stock and barrel removed for clarity.

With reference next to the drawings, there is shown a compressed air gun 10 having a stock 11, a barrel or launch tube 12 mounted to the stock 11, and a manual air pump 14. The air pump may be made of a clear plastic as shown in FIG. 1. The gun 10 has a pressure chamber 16 in fluid communication with the air pump 14 through a pressure tube 17, and a pressure actuatable release valve 18 mounted within the pressure chamber 16. Pressure chamber 16 is adapted to receive and store a supply of air at elevated pressure levels. The pressure chamber 16 has an air exit opening 19 in fluid communication with an end of barrel 12 which is positioned to cooperate with release valve 18. The release valve 18 has a cylindrical manifold 21 and a cylindrical plunger 22 slidably mounted within the manifold 21 for reciprocal movement therein. Plunger 22 has a gasket 23 which ensures sealing engagement of the plunger about pressure chamber opening 19 with the plunger in a closed position.

The pump 14 includes an elongated cylinder 25 and a plunger 26 telescopically mounted for reciprocal movement within the cylinder 25. Plunger 26 has a tubular shaft 27 with an enlarged sealing end 28 and a handle 29 opposite the sealing end 28. Sealing end 28 has an O-ring type seal 31 with an opening 32 therethrough, and a conventional check valve 33 mounted within opening 32 oriented to allow air to pass from the interior of cylinder 25 through opening 32 into the interior of shaft 27 and to prevent air from passing through opening 32 in the opposite direction. Handle 29 has a vent 34 therethrough which allows air to pass from ambience into the interior of shaft 27.

Pump cylinder 25 has an open end 36 through which plunger 26 extends and a closed end 37. The cylinder 25 also has a port 38 in fluid communication with pressure tube 17 and a vent 39 adjacent open end 36 which is open to ambience. Port 38 is spaced from closed end 37 so as to allow seal 31 of plunger 26 to be moved past the port 38 to a position closely adjacent to the closed end 37 as shown in FIG. 3.

Figure 2:
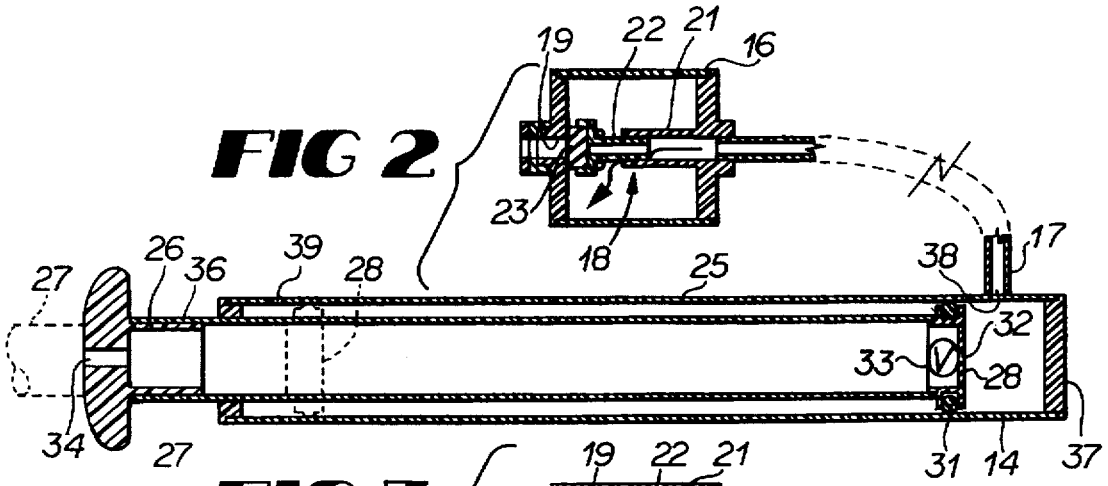
FIG. 2 is a cross-sectional view of the pump, pressure sensitive release valve and pressure chamber of the air gun of FIG. 1 showing the release valve in a closed configuration.

In use, an operator actuates the pump 14 by grasping the handle 29 and forcing the plunger 26 from a position with sealing end 28 adjacent cylinder open end 36, as shown generally in phantom lines in FIG. 2, through cylinder 25 towards port 38 thereby pressurizing air within the cylinder and pressure tube 17. The pressurized air flows through port 38 into pressure tube 17 where it then flows through pressure tube 17 into release valve manifold 21. The increase in air pressure within the release valve manifold 21 forces the valve plunger 22 to move to a forward position sealing opening 19, as shown in FIG. 2. The pressurized air then flows between the valve plunger 22 and the valve manifold 21 into pressure chamber 16 thereby pressurizing the air in chamber 16.

Figure 3:
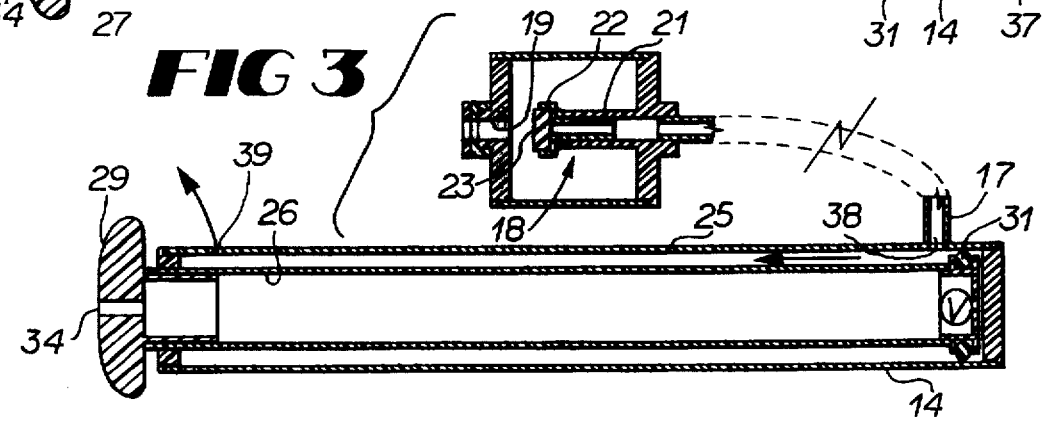
FIG. 3 is a cross-sectional view of the pump, pressure sensitive release valve and pressure chamber of the air gun of FIG. 1 showing the release valve in an open configuration.

With continued movement of the plunger 22 within cylinder 25 the plunger seal 31 of the pump passes past port 38, as shown in FIG. 3. With the plunger seal 31 in this position pressurized air within pressure tube 17 is released back into cylinder 25 behind seal 31 and to ambience through vent 39. The reentry of pressurized air into the cylinder 25 from pressure tube 17 causes the release valve plunger 22 to move to a rearward position unsealing opening 19 as shown in FIG. 3. Thus, the decrease in air pressure within the pressure tube 17 and release valve manifold 21 triggers the actuation of release valve 18 to its open configuration. With the unsealing of opening 19 pressurized air within pressure chamber 16 rapidly flows through opening 19 into the barrel 12 where it propels the projectile P from the barrel, as shown in FIG. 1. As air flows out of the pressure chamber into the launch chamber, only the slightest amount of air also back flows from the pressure chamber into the release valve manifold 21 since the plunger abuts the manifold. Operation of this type of release valve is described in more detail in U.S. Pat. No. 4,159,705.

Once the gun has been fired the plunger 26 may be manually reciprocated back to its initial position. The drawing back of the plunger does not create a vacuum within cylinder 25 since replenishment air may be drawn through vent 34 into the plunger handle 29, through the interior of shaft 27, and through check valve 33 into cylinder 25. Air between the cylinder 25 and the plunger 26 behind seal 31 is forced from cylinder 25 through vent 39.

The just described gun has the capability of being rapidly pressurized and fired in one continuous stroke. This allows a person to operate the gun with a quick, single stroke, rather than having to pressurize the gun and then actuate a trigger as with guns of the prior art. Additionally, it should be understood that the pump may be actuated so that the plunger is moved to a position close to its firing position so as to pressurize air and maintain the pressurized air in stored condition for later firing upon final movement of the plunger past port 38. In this mode manual pressure must be maintained to prevent the plunger 26 from retreating.

It should be understood that the just described air gun may also be adapted to cooperate with a rocket, as such it would be designed to resemble a rocket launcher rather than a conventional gun. The rocket may be adapted to be received within the launch tube or be adapted to receive the launch tube within a recess in the tail end of the rocket similarly to conventional toy rockets of the prior art.

While this invention has been described in detail with particular references to the preferred embodiment thereof, it should be understood that many modifications, additions and deletions may be made thereto without departure from the spirit and scope of the invention as set forth in the following claims.

We claim:

1. An air gun comprising a projectile launch tube; a pressure chamber in fluid communication with said launch tube; a pressure actuatable release valve means for triggering the release of pressurized air from said pressure chamber into said launch tube; and a manual air pump having a vented air cylinder with an open end, a closed end and a port spaced from said closed end, and a plunger that extends into said cylinder through said cylinder open end and which has a seal mounted in sliding, sealing engagement with said cylinder, whereby an inward stroke of the plunger seal toward the cylinder port pumps air into the pressure chamber through the release valve means and passage of the plunger seal past the port vents the cylinder to atmosphere to cause a pressure drop which actuates the pressure actuatable release valve means which triggers the release of pressurized air from the pressure chamber into the launch tube.

2. The air gun of claim 1 wherein said pump cylinder has a vent adjacent said open end.

3. The air gun of claim 1 further comprises check valve means for allowing air to pass into said pump cylinder as said plunger seal is moved from adjacent said closed end of said pump cylinder toward said open end of said pump cylinder.

4. The compressed air launcher of claim 3 wherein said check valve means is mounted to said plunger.

5. The compressed air launcher of claim 4 wherein said pump plunger has a tubular handle coupled to said seal with the interior of said tubular handle being in fluid communication with said check valve and ambience.

6. A compressed air gun comprising a launch tube; a pressure chamber coupled to the launch tube; and a pressure actuatable release valve for controlling the release of compressed air from the pressure chamber to the launch tube; and a manual air pump having an elongated cylinder having a first portion and a second portion extending from said first portion, a port positioned between said first portion and said second portion, a conduit having a first end coupled to said elongated cylinder port and a second end coupled to said pressure actuatable release valve, and a plunger having a sealing end slidably mounted within said elongated cylinder first and second portions, whereby movement of the plunger sealing end within the cylinder first portion toward the port causes air within the first portion and the conduit to be pressurized so as to cause the pressure actuatable valve to close, and whereby movement of the plunger sealing end past the port and into the second portion causes pressurized air within the conduit to be released into the elongated cylinder first portion behind the plunger so as to cause a pressure drop which in turn causes the pressure actuatable release valve to open.

7. The compressed air gun of claim 6 wherein said elongated cylinder has a vent.

8. The compressed air gun of claim 6 further comprises check valve means for allowing air to pass into said elongated cylinder as said plunger seal is moved within said cylinder first portion away from said port.

9. The compressed air gun of claim 8 wherein said check valve means is mounted to said plunger adjacent said sealing end.

10. The compressed air gun of claim 9 wherein said plunger has a tubular handle coupled to said sealing end with the interior of said tubular handle being in fluid communication with said check valve and ambience.

11. A compressed air launcher comprising:

a launch tube;

a pressure actuatable release valve for controlling the flow of pressurized air into said launch tube;

a conduit having a first end coupled to said pressure actuatable release valve and a second end opposite said first end; and a combination air pump and triggering means comprising an elongated cylinder having a first end and a second end, a port spaced from said first end and spaced from said second end, said port being coupled in fluid communication with said second end of said conduit, and a plunger having a seal movably mounted in said elongated cylinder for reciprocal movement, whereby movement of the seal within the cylinder in a direction from the first end toward the port causes air in the cylinder and the conduit to be pressurized thereby maintaining the pressure actuatable valve closed, and whereby movement of the seal within the cylinder past the port and toward the second end causes air in the conduit to be released into the elongated cylinder behind the plunger seal, to cause a pressure drop which actuates the pressure actuatable valve to open.

12. The compressed air launcher of claim 11 wherein said launcher is configured to resemble a gun.

13. The compressed air launcher of claim 11 wherein said elongated cylinder has a vent adjacent said first end.

14. The compressed air launcher of claim 11 wherein said combination air pump and triggering means further comprises check valve means for allowing air to pass into said elongated cylinder as said plunger seal is moved toward said first end of said elongated cylinder.

15. The compressed air launcher of claim 14 wherein said check valve means is mounted to said plunger adjacent said seal.

16. The compressed air launcher of claim 15 wherein said plunger has a tubular handle coupled to said seal with the interior of said tubular handle being in fluid communication with said check valve and ambience.

* * * * *